US010174264B2

(12) United States Patent
Morel et al.

(10) Patent No.: US 10,174,264 B2
(45) Date of Patent: Jan. 8, 2019

(54) PROCESS FOR THE PRODUCTION OF WHITE OILS FROM WASTE OILS

(71) Applicant: AXENS, Rueil Malmaison (FR)

(72) Inventors: Frederic Morel, Chatou (FR); Jerome Bonnardot, Le Chesnay (FR); Isabelle Guibard, St Symphorien D'Ozon (FR)

(73) Assignee: AXENS, Rueil Malmaison (FR)

( * ) Notice: Subject to any disclaimer, the term of this patent is extended or adjusted under 35 U.S.C. 154(b) by 456 days.

(21) Appl. No.: 14/564,879

(22) Filed: Dec. 9, 2014

(65) Prior Publication Data

US 2015/0315493 A1 Nov. 5, 2015

(30) Foreign Application Priority Data

Nov. 6, 2013 (FR) ..... 13 60856

(51) Int. Cl.

| | |
|---|---|
| ***C07C 5/00*** | (2006.01) |
| ***C10G 67/14*** | (2006.01) |
| ***C10G 65/04*** | (2006.01) |
| ***C10G 65/08*** | (2006.01) |

(52) U.S. Cl.

CPC ..... *C10G 67/14* (2013.01); *C10G 65/04* (2013.01); *C10G 65/08* (2013.01); *C10G 2300/1007* (2013.01); *C10G 2400/14* (2013.01)

(58) Field of Classification Search

CPC ..... C10G 67/14; C10G 65/04; C10G 65/08; C10G 2300/1007; C10G 2400/14

USPC ..... 585/240

See application file for complete search history.

(56) References Cited

U.S. PATENT DOCUMENTS

| | | | | |
|---|---|---|---|---|
| 3,392,112 | A * | 7/1968 | Bercik | C10G 65/08 208/143 |
| 3,629,096 | A * | 12/1971 | Divijak, Jr. | C10G 45/52 208/210 |
| 4,263,127 | A * | 4/1981 | Rausch | C10G 45/10 208/18 |
| 4,411,774 | A * | 10/1983 | Johnson | C10M 175/0016 208/179 |
| 4,512,878 | A * | 4/1985 | Reid | C10M 175/02 208/179 |
| 4,532,351 | A * | 7/1985 | Barnett | B01J 23/40 554/147 |
| 6,758,963 | B1 * | 7/2004 | Hantzer | B01J 23/002 208/108 |
| 7,261,808 | B2 * | 8/2007 | Grandvallet | C10M 175/0041 208/179 |
| 7,402,236 | B2 * | 7/2008 | Miller | C10G 45/64 208/24 |
| 2009/0166251 | A1 * | 7/2009 | Hantzer | C10G 45/04 208/58 |
| 2009/0223862 | A1 * | 9/2009 | MacDonald | C10G 71/00 208/184 |

OTHER PUBLICATIONS

"CFR-Code of Federal Regulations Title 21" (www.accessdata.fda.gov) (Information current as of Apr. 1, 2015).*

* cited by examiner

*Primary Examiner* — In Suk C Bullock
*Assistant Examiner* — Aaron W Pierpont
(74) *Attorney, Agent, or Firm* — Millen White Zelano & Branigan

(57) ABSTRACT

The present invention describes a process for the production of technical white oils or edible or medicinal oils from waste oils originating from industrial use or engine use, said process using a deep hydrotreatment.

13 Claims, No Drawings

PROCESS FOR THE PRODUCTION OF WHITE OILS FROM WASTE OILS

FIELD OF THE INVENTION

The invention relates to the field of the production of technical white oils from waste oils originating from industrial use or use in engines. It is known from the prior art to produce white oils from paraffinic or naphthenic feedstocks. Two main grades of white oils can be produced: technical white oils according to the standards specific to each country for edible or medicinal oils such as the CODEX in France or the United States Pharmacopeia, the National Formulary, and the Food and Drug Administration regulations in the USA, which all refer to at least one of the standards ASTM D2269 (UV Absorption on DMSO extract), ASTM D565 (Carbonizable substances) and ASTM D483 (Non-sulphonable residue). The type of impurity and its concentration in the waste oils to be treated in the process according to the invention can vary considerably from one waste oil to another, depending on their prior use.

EXAMINATION OF THE PRIOR ART

The patent FR 2,301,592 describes a process and an installation for the purification of waste oils, in particular mineral oils consisting of hydrocarbons of petroleum origin which have been modified after use and contain for example carbonaceous residues, oxidized products, water and unburnt hydrocarbons. The process described in this patent comprises elimination of water by heating or decanting, a stage of extraction of the waste oil by means of a paraffinic hydrocarbon, followed by separation of an extract and a raffinate. The paraffinic hydrocarbon contained in the extract is then removed, followed by distillation in order to separate a lubricating oil fraction and a residue.

Hydrogenation of the distilled fraction is then carried out. The residue originating from the distillation is treated on at least one adsorbent. Other processes involve treatments by means of an acid. These processes lead to losses in yield of oil and/or to prescribed waste such as acid sludges.

The process described in the patent FR 2,25,725 makes it possible to avoid treatments with adsorbents or acids. This process requires dehydration of the waste oil by heating, decanting, filtration or neutralization, followed by vacuum distillation producing an oil and a residue. The residue is directly subjected to an extraction stage in order to obtain an extraction residue and a clarified oil. The distilled and clarified oil fractions are then subjected to a hydrotreatment between 0.5 and 15 MPa at a temperature comprised between 240° C. and 400° C.

These treatments make it possible to produce a useable oil, but not an oil having the specifications of a technical white oil according to the standard 21 CFR 178.3620(b).

U.S. Pat. No. 3,629,096 describes a process for the production of technical white oil.

This process comprises stages of hydrocracking and hydro-isomerization and hydrogenation of the aromatic compounds in addition to the hydrotreatment stage.

U.S. Pat. No. 4,072,603 describes the production of technical white oils by means of a single-stage hydrogenation process. However it is stated that the feedstock of the hydrogenation reactor is an oil that has been previously hydrocracked and extracted by means of a solvent. The hydrogenation catalyst is a nickel-tungsten catalyst on silica-alumina.

The prior art thus describes processes utilizing waste oils, but the products originating from the treatment of these oils are indeed oils that can be recycled for use in engines, but not technical white oils.

The prior art also mentions processes allowing the production of technical white oils, but these processes utilize feedstocks which are either mineral oils originating from an aromatics extraction treatment using furfural and from solvent dewaxing, or paraffinic products originating from hydrocracking of distillates under vacuum followed by solvent dewaxing, or paraffins originating from Fischer-Tropsch conversion optionally followed by solvent dewaxing.

Furthermore, when the feedstock contains aromatic compounds, it is usually necessary to remove these residual aromatic compounds by means of an additional hydrogenation stage ("hydrofinishing") after a first hydrogenation or hydrotreatment stage (cf. U.S. Pat. No. 5,453,176) in order to improve the UV absorbance properties of the oil (according to the standard ASTM D2008).

BRIEF DESCRIPTION OF THE INVENTION

The process according to the present invention differs from the processes according to the prior art in that it makes it possible to obtain technical white oils by sending a waste oil or a cut originating from the fractionation of waste oils originating from engines or industry, previously dehydrated, directly into a deep hydrotreatment section, without any other prior hydrocracking treatment, or solvent extraction of the aromatics or solvent dewaxing.

The process according to the invention also differs from the prior art in that it implements a stage of hydrotreatment in the presence of a supported nickel- and molybdenum-based catalyst at a temperature comprised between 280° C. and 400° C. and a pressure comprised between 15.5 MPa and 25 MPa.

More precisely, the present invention can be defined as a process for the production of technical white oils from waste oils originating from industrial use or use in engines, comprising the following sequence of stages:

- a dehydration stage making it possible to eliminate water and various light additives,
- a demetallization stage,
- a first deep hydrotreatment stage taking place in the presence of a nickel- and molybdenum-based, or nickel- and tungsten-based catalyst, supported under the following operating conditions:
- temperature comprised between 250° C. and 450° C., preferably comprised between 280° C. and 400° C., and more preferably comprised between 300° C. and 380° C.,
- a pressure comprised between 15.5 MPa and 25 MPa, preferably comprised between 15.8 MPa and 23 MPa, and more preferably comprised between 16 MPa and 21 MPa (1 MPa denotes the abbreviation of Mega Pascal and is therefore equivalent to $10^6$ Pascal, i.e. approximately 10 bar).
- LHSV comprised between 0.1 and 10 $h^{-1}$, preferably comprised between 0.1 and 5 $h^{-1}$ and more preferably comprised between 0.2 and 3 $h^{-1}$.
- flow rate of hydrogen comprised between 100 normal liters/liter of feedstock and 3000 normal liters/liter of feedstock, preferably comprised between 500 normal liters/liter of feedstock and 2000 normal liters/liters of feedstock.

This first stage of deep hydrotreatment is completed by a second stage of hydrotreatment essentially consisting of hydrogenation of the aromatic hydrocarbons contained in the effluent from the first stage of hydrotreatment in the presence of a catalyst based on noble metals selected from the list: Pt, Pd, Ru, Rh, preferably from the sub-list Pt or Pd, and very preferably restricted to Pt.

Said noble metal or metals for said second stage of hydrotreatment are generally deposited on any type of support, for example silica, alumina, silica-alumina, zirconium, titanium oxide or a mixture thereof in any proportions, preferably silica, alumina or silica-alumina, and very preferably alumina.

The operating conditions for said second stage of hydrotreatment are generally as follows:

- Pressure comprised between 5 and 25 MPa, preferably comprised between 8 and 20 MPa,
- LHSV comprised between 0.1 and 10 $h^{-1}$, preferably comprised between 0.2 and 3 $h^{-1}$, and
- Temperature comprised between 150 and 450° C., preferably between 200 and 400° C.

According to a preferred variant of the process for the production of technical white oils according to the present invention, the dehydration stage comprises a preheating of the oil, either in an exchanger, or in a specially equipped oven at a temperature comprised between 50° C. and 200° C., preferably between 80° C. and 150° C.

According to another variant of the process for the production of technical white oils according to the present invention, the dehydration stage is coupled with a distillation such that the temperature of said distillation is maintained below 250° C., and preferably between 100° C. and 200° C., even more preferably between 120° C. and 150° C.

According to another variant of the process for the production of technical white oils according to the present invention, the demetallization stage is carried out at a temperature comprised between 200° C. and 400° C. and a pressure comprised between 0.5 MPa and 30 MPa with an LHSV comprised between 0.1 and 10 $h^{-1}$.

According to another variant of the process for the production of technical white oils according to the present invention, the stage of deep hydrotreatment uses a catalyst comprising nickel, molybdenum and an alumina-based support.

According to a variant of the present process, the demetallization and deep hydrotreatment stages are carried out under the same temperature, pressure and LHSV conditions.

DETAILED DESCRIPTION OF THE INVENTION

The waste oils used as feedstock for the process according to the invention are generally mineral oils made up of hydrocarbons, usually but not exclusively of petroleum origin. These oils contain additives such as for example antirust agents, antioxidants, emulsifiers, pour point depressants (PPDs), or viscosity index improvers (VIIs). They have been partly degraded by oxidation or formation of carbon-based residues or unburnt hydrocarbons, after use in an industrial machine or an internal combustion engine. The waste oil feedstock is filtered in order to eliminate the solid particles in suspension, then the water contained in the feedstock is eliminated in a dehydration stage by means of any process known to a person skilled in the art, for example by decanting or moderate heating and optionally distillation.

According to a preferred variant of the process according to the invention, the dehydration stage comprises a preheating of the oil, either in an exchanger, or in a specially equipped oven, at a temperature comprised between 50° C. and 200° C., preferably between 80° C. and 150° C.

This dehydration stage is, according to a first variant, associated with a distillation, generally carried out at atmospheric pressure or under moderate vacuum in order to avoid additional deterioration of the oil.

Thus the distillation temperature can be maintained below 250° C., and preferably between 100° C. and 200° C., more preferably between 120° C. and 150° C. This makes it possible to eliminate the water, the light hydrocarbons and the various light additives simultaneously or successively.

The dehydrated oil is then distilled in a column under vacuum in order to remove the residual fraction of the oil. This distillation operation is generally carried out under a high vacuum.

The temperature at the bottom of the column is high, between 300 and 400° C. According to a preferred variant, the distillation consists of a fractionation allowing the production of several grades of oils having different viscosities (from 2 to 5 oil grades).

The dehydrated oil is then sent to a hydrotreatment section. Given the metallic and mineral impurities contained in a waste oil, it is usually necessary to eliminate these metals by trapping them on an absorbent material or a catalyst. This demetallization stage is generally carried out just before or simultaneously with the hydrotreatment stage.

It is possible, according to a first variant, to trap these metals on the hydrotreatment catalyst generally at the head of the catalytic bed when the catalyst is arranged in a fixed bed.

According to another more preferred variant, it is possible to arrange a specific demetallization catalyst and the hydrotreatment catalyst either in two separate reaction sections comprising at least one reactor, or in the same reaction section by arranging the hydrodemetallization catalyst at the head of this section, therefore at the head of the first or only hydrotreatment reactor.

The demetallization catalyst generally comprises catalysts with a support, at least one oxide or sulphide of a group VIIIB metal, preferably nickel or cobalt and/or at least one oxide or sulphide of a group VIB metal, preferably chromium, molybdenum or tungsten. It can optionally comprise several group VIIIB metals, for example nickel and cobalt. The group VIB metal content of said catalyst is generally comprised between 1 wt % and 30 wt % and preferably comprises between 2 wt % and 15 wt %. The group VIIIB metal content is generally comprised between 1 wt % and 10 wt %.

Preferably, the support of the demetallization catalyst is constituted by silica, alumina or silica-alumina, and very preferably alumina alone.

The hydrotreatment catalyst according to the invention comprises a support, for example alumina or silica or a silica-alumina, or titanium or zirconium oxide, or a mixture of these oxides. The hydrotreatment catalyst also comprises nickel or cobalt and molybdenum.

According to a very preferred variant, the hydrotreatment catalyst according to the invention comprises nickel, molybdenum and an alumina-based support.

The nickel or cobalt content of said catalyst is generally comprised between 1 wt % and 20 wt %, and preferably comprised between 1 wt % and 10 wt %.

The molybdenum content of said catalyst is generally comprised between 1 wt % and 30 wt %, and preferably comprised between 5 wt % and 20 wt %.

The demetallization and hydrotreatment catalysts can be operated under conditions that are identical or different in terms of pressure, temperature and LHSV.

The demetallization catalyst can be operated at a temperature comprised between 200° C. and 400° C. and a pressure comprised between 0.5 MPa and 30 MPa with an LHSV comprised between 0.1 and 10 $h^{-1}$.

The hydrotreatment catalyst can be operated at a temperature comprised between 250° C. and 450° C., preferably comprised between 280° C. and 400° C., and more preferably comprised between 300° C. and 380° C., and a pressure comprised between 15.5 MPa and 25 MPa, preferably comprised between 15.8 MPa and 23 MPa, and more preferably comprised between 16 MPa and 21 MPa, with an LHSV comprised between 0.1 and 10 $h^{-1}$, preferably comprised between 0.1 and 5 h and more preferably comprised between 0.2 and 3 $h^{-1}$.

The hydrogen is supplied at a flow rate comprised between 100 normal liters/liter of feedstock and 3000 normal liters/liter of feedstock, preferably comprised between 500 normal liters/liter of feedstock and 2000 normal liters/liters of feedstock.

According to a second variant of the process according to the invention, the oil originating from the dehydration stage is sent directly to the demetallization and/or hydrotreatment stage, the distillation stage being positioned after said hydrotreatment.

EXAMPLES ACCORDING TO THE INVENTION

Example 1 (According to the Invention)

The feedstock of the process is a waste oil constituted by a mixture of engine oils and industrial oils which have an initial boiling point equal to 100° C. and a final boiling point equal to 600° C. This feedstock has the properties indicated in Table 1 below.

Said feedstock initially contains 5% water and undergoes dehydration by moderate vacuum distillation.

It is then fractionated into 3 cuts having the following boiling points:

Boiling points of the different cuts: 350-420° C., 420-480° C. and 480-540° C.

The 420-480° C. cut is sent to a deep hydrotreatment stage according to the invention.

The deep hydrotreatment unit comprises 2 reactors:

The 1st reactor is loaded with nickel-, cobalt- and molybdenum-based hydrodemetallization catalyst on alumina HF858$^{RT}$ marketed by the company Axens.

The 2nd reactor is loaded with nickel- and molybdenum-based hydrotreatment catalyst on alumina HR 548$^{RT}$ marketed by the company Axens.

The operating conditions of the two reactors are as follows: pressure=17 MPa, LHSV=0.24 $h^{-1}$ (hourly volume flow rate of the cut entering the reactor per volume of catalyst) and temperature=340° C. Pure hydrogen is supplied at a flow rate of 1000 normal liters/liter of feedstock.

The reactor effluent is vapour-stripped in order to remove the light compounds formed and to adjust the flash point, then dried in a dryer under vacuum.

The properties of the product obtained are recorded in Table 1 below.

The product obtained is a technical white oil.

In particular, the colour of the product remains above the specification of 20 even after several months' storage.

TABLE 1

| Property | Waste oil | Dehydrated oil | Distilled Cut (PI 420° C.-PF 480° C.) | Product | CFR 178.3620(b) specifications |
|---|---|---|---|---|---|
| Density at 15° C. | 0.893 | 0.898 | 0.865 | 0.850 | |
| Viscosity at 40° C. (cSt) | 53 | 56 | 30.20 | 25.20 | |
| Viscosity at 100° C. (cSt) | 5.7 | 5.6 | 5.30 | 4.85 | |
| Viscosity index | | | 109 | 115 | |
| Flash point (° C.) | | | 210 | 210 | |
| Aromatics (wt %) | | | 19 | 5 | |
| Sulphur (ppm) | 7000 | 7600 | 4500 | <5 | |
| Silicon (ppm) | 150 | 165 | 60 | <1 | |
| Other metals (ppm) | 4000 | | 20 | <1 | |
| Water (wt %) | 5 | <0.1 | <0.1 | <0.1 | |
| Saybolt Colour ASTM D156 | | | | 30 | >20 |
| PCB (ppm) | 49 | 51 | 43 | 5 | |
| PCA IP 346 (wt %) | 2.5 | 2.7 | 2.1 | 0.1 | |
| UV Absorbance (ASTM D2008) | | | | | |
| 280 to 289 nm | | | 2.5 | 0.05 | |
| 290 to 299 nm | | | 1.8 | 0.03 | |
| 300 to 359 nm | | | 1.4 | 0.02 | |
| 359 to 400 nm | | | 0.25 | 0.01 | |

Notes:

PCB: Polychlorobiphenyl

PCA: Polycyclic aromatics

Example 2 (Comparative)

This example is identical to Example 1 except for the pressure of the HDT stage which is at present approximately 13.5 MPa.

The UV are shown in Table 2 below.

TABLE 2

| UV absorbance (ASTM D2008) | Values obtained |
|---|---|
| 280 to 289 nm | 0.10 |
| 290 to 299 nm | 0.08 |
| 300 to 359 nm | 0.05 |
| 359 to 400 nm | 0.03 |

The other properties have values identical to those of Example 1.

The colour of the product at the reactor exit (colour ASTM D156>20) still meets the specifications of the standard CFR 178.3620(b) with a value of 24. However, this colour is not stable over time and degrades during storage. Thus, after one week's storage, and despite the presence of antioxidant additives, the ASTM D156 colour is reduced to a value of 13. The product therefore no longer meets the CFR 178.3620(b) specifications which require a colour>20.

The operating pressure of 13 MPa is therefore too low for the production of technical white oils.

Example 3 (Comparative)

This example is identical to Example 1, but with a nickel tungsten (Ni W) catalyst instead of nickel molybdenum (NiMo).

The replacement of the nickel-molybdenum catalyst with a nickel-tungsten catalyst with the same operating conditions as in Example 1 produces a white oil having the UV absorbances shown in Table 3 below:

TABLE 3

| UV absorbance (ASTM D2008) | Values obtained |
|---|---|
| 280 to 289 nm | 1.0 |
| 290 to 299 nm | 0.8 |
| 300 to 359 nm | 0.5 |
| 359 to 400 nm | 0.15 |

Example 4 (Comparative)

This example is identical to Example 1 except as regards the pressure of the HDT stage which is 27 MPa.

In this example, the UV absorbances (ASTM D2008) are better than in the reference example (Cf. Table 4 below):

TABLE 4

| UV absorbance (ASTM D2008) | |
|---|---|
| 280 to 289 nm | 0.03 |
| 290 to 299 nm | 0.02 |
| 300 to 359 nm | 0.01 |
| 359 to 400 nm | 0.005 |

Thus there is a needless excess of quality of the product in respect of which no benefit can be derived through a higher sale price.

Furthermore, operating at a pressure of 27 MPa gives rise to a number of constraints.

In fact, the resistance to such pressures requires specific flanges and lines and wall thickness for the reactors and exchangers, leading to significant weight for the most bulky equipment and therefore manufacturing and transport problems.

This equipment no longer corresponds to standard manufacturing requirements and these special constructions have a much higher cost.

This extra cost in terms of capital expenditure is calculated at 40% of the total cost of the hydrotreatment unit.

Example 5 (According to the Invention)

In this example, the production of medicinal or edible white oil meeting the Codex specifications is described.

For this purpose, the technical white oil which is the product originating from the hydrotreatment described in Example 1 above, is treated in a $2^{nd}$ stage consisting of hydrogenation of the aromatic compounds, in order to arrive at virtually total saturation of the aromatic compounds.

The conditions of this $2^{nd}$ stage are as follows:

Catalyst: Platinum-based LD402 marketed by the company Axens.

Pressure $H_2$: 14 MPa

LHSV: 0.3 l/(l·h)

Temperature: 300° C.

The resulting product meets the Codex specifications for medicinal white oils as shown in Table 5 below.

The standard ASTM D565 consists of treating the oil with concentrated sulphuric acid then, under conditions prescribed in the standard, comparing the resulting colour with a standard reference sample. This makes it possible to determine whether or not the sample is in conformity with this standard.

TABLE 5

| | Values obtained in $1^{st}$ stage | Values obtained in $2^{nd}$ stage | Codex Specification Medicinal white oils |
|---|---|---|---|
| UV absorbance (ASTM D2008) | | | |
| 280 to 289 nm | 0.05 | 0.0008 | <0.001 |
| 290 to 299 nm | 0.03 | 0.0005 | <0.001 |
| 300 to 359 nm | 0.02 | 0.0003 | <0.001 |
| 359 to 400 nm | 0.01 | 0.0001 | <0.001 |
| ASTM D156 Colour | 30 | 30 | 30 |
| UV Absorbance on DMSO extract ASTM D2269 | 0.25 | 0.06 | <0.1 |
| Carbonizable Substance ASTM D565 | Not in conformity with the standard | In conformity with the standard | In conformity with the standard |
| Non-sulphonable Residue ASTM D483 | 97% | 99.5% | >99% |

Without further elaboration, it is believed that one skilled in the art can, using the preceding description, utilize the present invention to its fullest extent. The preceding preferred specific embodiments are, therefore, to be construed as merely illustrative, and not limitative of the remainder of the disclosure in any way whatsoever.

The preceding examples can be repeated with similar success by substituting the generically or specifically described reactants and/or operating conditions of this invention for those used in the preceding examples.

From the foregoing description, one skilled in the art can easily ascertain the essential characteristics of this invention and, without departing from the spirit and scope thereof, can make various changes and modifications of the invention to adapt it to various usages and conditions.

The entire disclosures of all applications, patents and publications, cited herein and of corresponding French Application No. 13/60856, filed Nov. 6, 2013, are incorporated by reference herein.

The invention claimed is:

1. A process for the production of a white oil, comprising;

(I) obtaining a waste oil from industrial use or from use in engines;

(II) subjecting the waste oil to a dehydration stage to eliminate water, light hydrocarbons, and light additives in the waste oil to produce a dehydrated oil;

(III) subjecting the dehydrated oil to a vacuum distillation stage to obtain a 420-480° C. range distilled cut;

(IV) subjecting said 420-480° C. range distilled cut to a demetallization stage in the presence of a demetallization catalyst comprising a Group VIB metal and at least two Group VIIIB metals to produce a demetallized product, wherein the demetallization stage is carried out at (i) a temperature between 200° C. and 400° C., (ii) a pressure between 0.5 MPa and 30 MPa, and (iii) an LHSV between 0.1 and 10 $h^{-1}$, and wherein the demetallization catalyst has a Group VIIIB metal content between 1 wt % and 10 wt % and a Group VIB metal content between 2 wt % and 15 wt %;

(V) subjecting said demetallized product to a first deep hydrotreatment stage in the presence of (i) a supported nickel- and molybdenum-based catalyst, or (ii) a nickel- and tungsten-based catalyst to produce a deep hydrotreated product, wherein the deep hydrotreatment stage takes place under the following conditions:

(1) a temperature of between 250° C. and 450° C., (2) a pressure between 17 MPa and 21 MPa, (3) an LHSV between 0.1 and 10 $h^{-1}$, and (4) a flow rate of hydrogen between 100 and 3,000 normal liters/liter of feedstock;

(VI) subjecting said deep hydrotreated product to a second hydrotreatment stage in the presence of a catalyst comprising a noble metal deposited on a support, wherein the noble metal is selected from the group consisting of Pt, Pd, Ru, Rh, and combinations thereof, wherein the second hydrotreatment stage comprises hydrogenating aromatic hydrocarbons contained in the deep hydrotreated product to produce said white oil under the following operating conditions:

(1) a pressure between 5 MPa and 25 MPa, (2) a LHSV between 0.1 and 10 $h^{-1}$, and (3) a temperature between 150° C. and 450° C.;

(VII) recovering said white oil from the second hydrotreatment stage, wherein said white oil has a Saybolt Color value of >20, as determined by the ASTM D156 method.

2. The process according to claim 1, in which the dehydration stage comprises preheating the waste oil, either in an exchanger or in an oven at a temperature of 50° C. to 200° C.

3. The process according to claim 1, in which the temperature during said vacuum distillation stage is maintained below 250° C.

4. The process according to claim 1, in which the demetallization catalyst comprises at least one oxide or sulphide of a Group VIIIB metal and/or at least one oxide or sulphide of a Group VIB metal.

5. The process according to claim 1, in which the demetallization catalyst has a Group VIIIB metal content of between 1 wt % and 5 wt % and a Group VIB metal content of 5 wt % to 10 wt %.

6. The process according to claim 1, in which the catalyst employed in the first deep hydrotreatment stage is a supported nickel- and molybdenum catalyst, wherein the support is alumina.

7. The process according to claim 1, in which the demetallization stage and the first deep hydrotreatment stage are carried out under the same temperature, pressure, and LHSV conditions.

8. The process according to claim 1, in which the noble metal of the catalyst employed in the second hydrotreatment stage is selected from the group consisting of Pt, Pd, and combinations thereof.

9. The process according to claim 8, wherein the support of the catalyst employed in the second hydrotreatment stage is selected from the group consisting of silica, alumina, silica-alumina, zirconium, titanium oxide, and mixtures thereof.

10. The process according to claim 4, wherein the Group VIIIB metal in the at least one oxide or sulphide of a Group VIIIB metal is nickel or cobalt, and the Group VIB metal in the at least one oxide or sulphide of a Group VIB metal is chromium, molybdenum, or tungsten.

11. The process according to claim 8, wherein the catalyst employed in the second hydrotreatment stage includes Pt and the support employed in the second hydrotreatment stage is selected from the group consisting of silica, alumina, and silica-alumina.

12. The process according to claim 1, wherein the vacuum distillation stage is conducted in a thin-film evaporator.

13. A process for the production of a technical white oil, comprising:

(I) obtaining a waste oil from industrial use or from use in engines;

(II) subjecting the waste oil to a dehydration stage to eliminate water, light hydrocarbons, and light additives in the waste oil to produce a dehydrated oil;

(III) subjecting the dehydrated oil to a vacuum distillation stage to obtain a 420-480° C. range distilled cut;

(IV) subjecting said 420-480° C. range distilled cut to a demetallization stage to produce a demetallized product;

(V) subjecting said demetallized product to a hydrotreatment stage in the presence of (i) a supported nickel- and molybdenum-based catalyst, or (ii) a nickel- and tungsten-based catalyst to produce said technical white oil, wherein the hydrotreatment stage takes place under the following conditions:

(1) a temperature between 250° C. and 450° C., (2) a pressure between 17 MPa and 21 MPa, (3) an LHSV between 0.1 and 10 $h^{-1}$, and (4) a flow rate of hydrogen between 100 and 3,000 normal liters/liter of feedstock; and (VI) recovering said technical white oil from the hydrotreatment stage, wherein said technical white oil has a Saybolt Colour Color value of >20, as determined by the ASTM D156 method.

* * * * *